United States Patent [19]

Naill

[11] 3,943,393

[45] Mar. 9, 1976

[54] STRESS FREE FILAMENT STRUCTURE

[75] Inventor: Eugene J. Naill, New Canaan, Conn.

[73] Assignee: The Machlett Laboratories, Inc., Stamford, Conn.

[22] Filed: Feb. 13, 1975

[21] Appl. No.: 549,636

[52] U.S. Cl. ..... 313/60; 313/55; 313/331; 313/332

[51] Int. Cl.[2] ..... H01J 35/02; H01J 5/62

[58] Field of Search ..... 313/332, 331, 60, 55

[56] References Cited

UNITED STATES PATENTS

| | | | |
|---|---|---|---|
| 2,426,251 | 8/1947 | Taylor et al. | 313/332 X |
| 3,675,068 | 7/1972 | Strauss | 313/332 X |
| 3,821,581 | 6/1974 | Holland et al. | 313/60 |

*Primary Examiner*—R. V. Rolinec
*Assistant Examiner*—Darwin R. Hostetter
*Attorney, Agent, or Firm*—Harold A. Murphy; Joseph D. Pannone; John T. Meaney

[57] ABSTRACT

An electron discharge device such as an X-ray tube having a filamentary cathode arranged to discharge electrons onto an adjacent anode wherein the filament is an elongated member fixed at its ends to respective filament support posts which are each mounted within a metal eyelet fastened within the bore of a nonconductive sleeve, respective lead wires being connected to opposite ends of the posts by flexible metal connectors whereby upon applications of heat to the assembly mechanical and thermal stresses, as might normally cause distortion of the parts and particularly of the filament, will be absorbed by the connectors.

11 Claims, 5 Drawing Figures

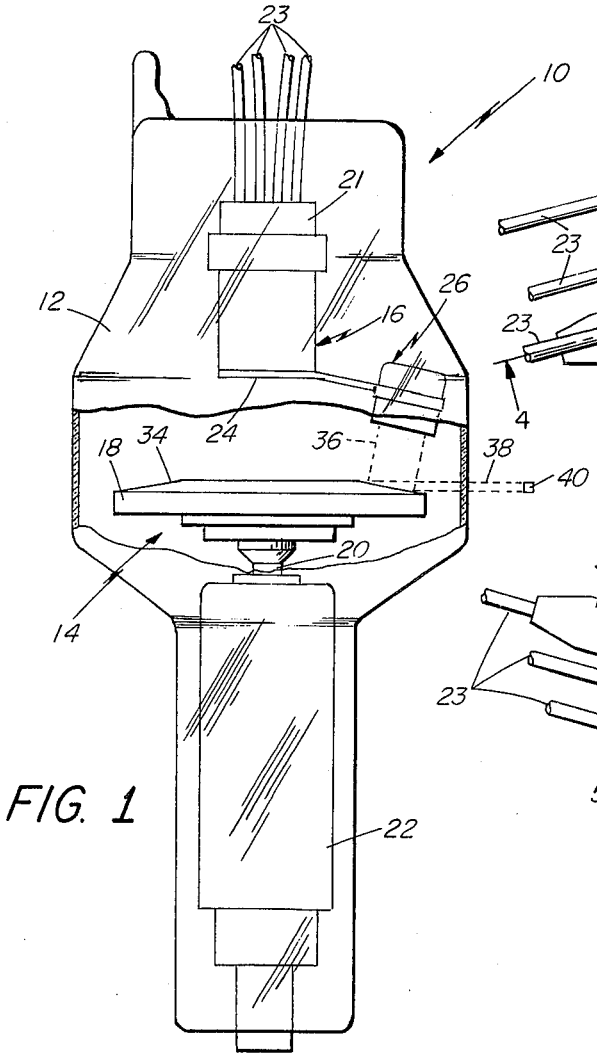
FIG. 1
FIG. 3
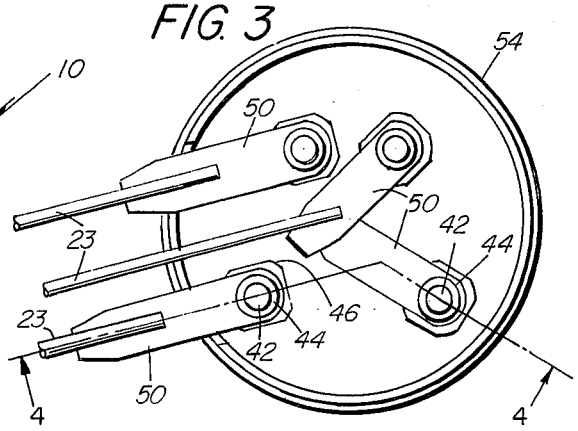
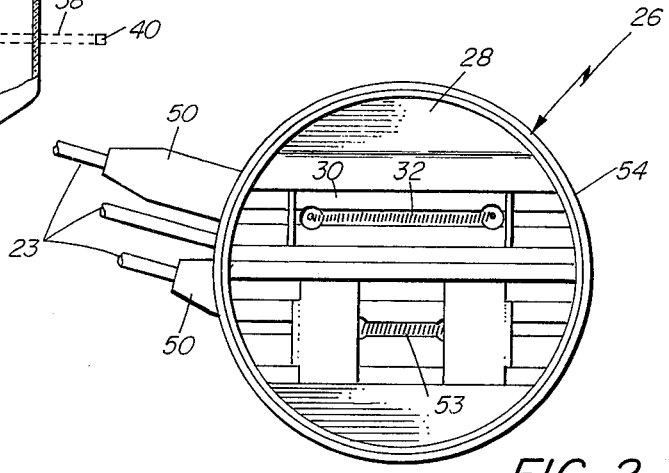
FIG. 2
FIG. 4
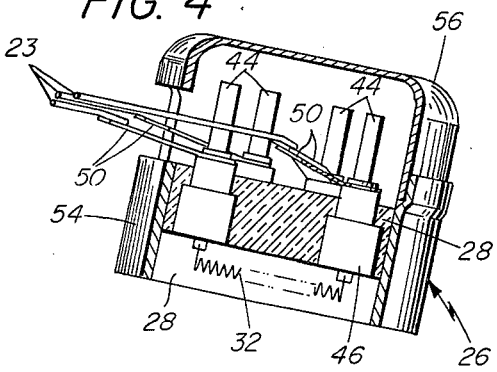
FIG. 5
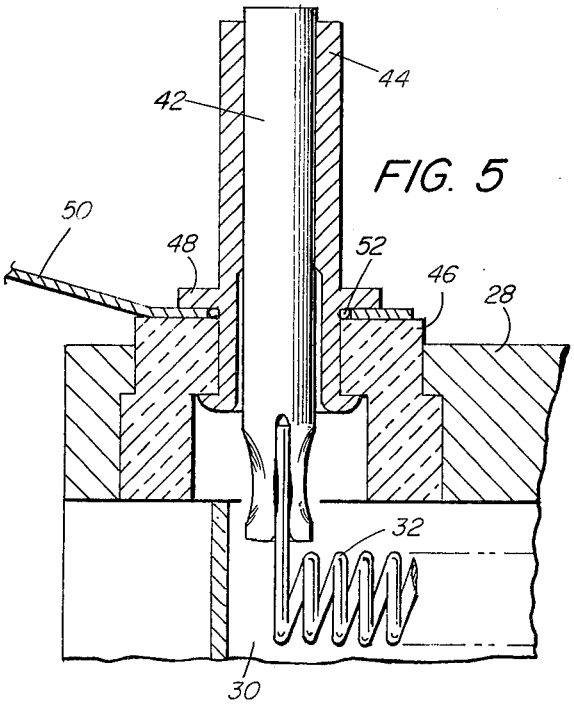

STRESS FREE FILAMENT STRUCTURE

BACKGROUND OF THE INVENTION

In the manufacture of electron discharge devices employing a cathode which emits electrons onto an anode, the electronemitting member is frequently a filamentary coil of relatively small diameter wire which is heated to incandescence by the application of suitable filament current. During this process copious supplies of electrons are directed onto a selected area of the anode.

In such devices, and particularly in X-ray tubes, the filament is precisely controlled as to length and diameter so as to form a specifically shaped electron beam which will be focused onto a single discrete area of the anode surface known as the focal spot, which area is of a predetermined size. In an X-ray tube the anode surface will be angled at an inclination of about 10° – 15°, for example, and the focal spot will be a rectangular shape. However, when viewed from one side, the virtual focal spot will appear as substantially square, having four sides about 1.2 mm long, for example.

In order to achieve a focal spot of the desired size and shape, the filament may be mounted within a metal focusing cup or head to which suitable electrical potential is applied so as to aid in shaping the electron beam to produce the desired spot. This is fully explained in U.S. Pat. No. 3,103,591 and further described in U.S. Pat. No. 3,743,836, both of which patents are assigned to the assignee of this application.

It has been found that during operation of a tube having a filament type cathode of this nature the focal spot sometimes becomes altered in size and shape. This is believed to be due to the fact that the filament support structure becomes subjected to extremely high temperatures such as about 900° – 950° C, for example, which creates thermal and mechanical stresses tending to distort the parts and consequently, to also deform the filament.

The ends of the filament are fixed to the ends of spaced metal posts with substantially their entire lengths spanning the space between the posts. The posts, which are conveniently of molybdenum, are supported within sleeves or eyelets of nickel which are in turn mounted within bores formed in insulators, preferably of ceramic, fixed to the cathode head. Lead wires of nickel or the like are welded to the eyelets for providing the filament with suitable filament potential. It is believed that heat stresses within the lead wire-eyelet-post assembly causes the aforesaid undesirable distortion of the filament which produces undesirable alternation of the electron beam. In some cases distortion of the filament has been severe enough to cause shorting of the filament with closely spaced portions of the cathode head.

SUMMARY OF THE INVENTION

The foregoing and other objections to prior art cathode structures are overcome by the present invention wherein the filament-supporting posts are connected to lead wires by flexible metal connectors which, during operation of the device, will absorb stresses and strains and prevent them from being transmitted to the filament.

The filament ends are fixed to respective metal posts which are positioned within metal sleeves or eyelets of nickel carried by ceramic insulating members mounted in the cathode head. In accordance with this invention, one end of a flexible nickel connector is attached at one end to each eyelet by a titanium bond, which material efficiently alloys with the eyelet and the connector and bonds to the ceramic for a stable joint. The lead wires are welded to the connectors without introducing any appreciable strain on the eyelets.

Thereafter, during operation of the tube and consequent subjection of the assembly to high temperatures, any thermal and mechanical stresses from the leads are absorbed by the flexible connectors without substantial transference to the eyelets. Thus, no shorting occurs and no distortion of the filament, electron beam or focal spot results.

BRIEF DESCRIPTION OF THE DRAWINGS

The above and other objectives of this invention will become apparent from the following description taken in connection with the accompanying drawings, wherein:

FIG. 1 is an elevational view of an X-ray tube having a cathode structure embodying the invention;

FIG. 2 is one end view of the cathode structure showing a pair of filaments therein;

FIG. 3 is an opposite end view of the cathode head shown in FIG. 2 without a cap thereon;

FIG. 4 is a vertical sectional view through the cathode structure taken along line 4—4 of FIG. 3 looking in the direction of the arrows; and FIG. 5 is an enlarged fragmentary longitudinal sectional view through a filament-supporting assembly embodying the invention.

DESCRIPTION OF THE PREFERRED EMBODIMENT

Referring more particularly to the drawings wherein like characters of reference designate like parts throughout the several views, FIG. 1 depicts an X-ray tube of the rotating anode type as an example of an electron discharge device in which the invention may be embodied.

The x-ray tube 10 comprises a dielectric envelope 12 of glass, ceramic or the like having an anode structure 14 in one end and a cathode structure 16 in the other end. The anode structure 14 includes a disc-like target 18 which is mounted on one end of a rotatable shaft 20 which is in turn disposed within a suitable rotor structure 22 for rotation about a longitudinal axis.

The cathode structure 16 includes a support 21 which is suitably affixed to an end portion of the envelope 12 by means not shown in a manner whereby lead wires 23 extend therefrom through the envelope wall for connection to a suitable external source of filament current. To the inner end of the support 20 is fixed one end of a support plate 24, the other end of the plate 24 extending substantially radially within the envelope and having a cathode head 26 mounted thereon.

The cathode head 26 comprises a focusing cup 28 in a form of a metal block having a generally planar face wherein there is disposed an elongated recess 30 or series of communicating cavities, each having a generally rectangular configuration. Within the recess is disposed a longitudinally extending filament 32 which is a helical winding of wire of a material which is known to emit substantial supplies of electrons when heated by electrical current. The filament 32 is connected at its ends, by means to be described, to leads 23 for application of filament current thereto.

The cathode head 26 is adapted to be disposed with the filament 32 located opposite an inclined marginal surface 34 of the target 18 at a predetermined interelectrode spacing therefrom. Upon application of current to the filament 32, electrons will be emitted in the form of a beam 36 which is directed toward the inclined surface 34 of the target 18. The point of impact of the electron beam upon surface 34 is known as the focal spot, and this focal spot is precisely controlled as to size and shape in the manner set forth in the aforementioned U.S. Pat. Nos. 3,103,591 and 3,743,836. To achieve this control of the focal spot, suitable different potentials are applied between the focusing cup 28 and the anode 14 and, through the shaping of the recess 30, forms the electron beam to the desired contour which will provide the desired focal spot. As shown in FIG. 1 by dotted lines 38, the focal spot 40 will appear as a small square when viewed from the side along a line perpendicular to the axis of the anode structure 14. Upon such electron bombardment of the target surface 34, the focal spot will emit X-radiation which is directed outwardly through the side wall of the envelope.

The X-ray focal spot size is the subject of industrial and medical standards which set limits on the maximum dimensions permissible. Since the power ratings of the tube varies, accurate control of the focal spot dimensions is essential.

As shown in FIG. 5, the filament 32 is welded or otherwise securely connected at each end to a metal post 42 which is disposed within a metal sleeve or eyelet 44 carried by a ceramic insulator 46 which is in turn fixed within a suitable opening extending through the cathode head 28. In prior art cathode structures of this nature the lead wires 22 have been welded directly to the respective eyelets 44 and when the tube is subsequently operated it has been found that thermal and mechanical stresses occur in the filament support structure to such a degree that the filament 32 becomes distorted and sometimes even shorts against a wall of the recess. This distortion, of course, results in the production of an improperly shaped electron beam, with a resultant alteration of the size and shape of the focal spot. The shorting will cause burnout of the filament.

In accordance with this invention, the filament 32 is secured to the adjacent end of the post 42 as heretofore. However, the eyelet 44 is provided with a circumferential flange 48 which overlies the outer end of the insulator, and a flexible metal connector 50 is positioned therebetween. Connector 50 comprises an elongated thin metal member which has one end welded to a lead wire 22 and has an opening in its opposite end through which the eyelet 44 extends. Between the connector and the eyelet there is disposed a ring 52 of titanium which material is known, when heated and melted, to alloy with the material of the eyelet and to bond securely to the material of the insulator, thus forming a stable joint therebetween.

The lead wires 22, eyelet 44 and connector 50 are preferably formed of nickel, and the insulator is preferably made of ceramic. With such a structure, it has been found that during tube operation, generation of heat up to as high as 900° – 950° C, for example, or higher has no substantial effect on the structure since the flexible connector 50 absorbs resultant mechanical and thermal stresses. Therefore, the filament 32 and the focal spot retain their original desired sizes and shapes.

While the invention has been described in connection with one filament 32 only, it will be apparent that additional filaments such as filament 53 may be additionally provided in cathode head 28 and will be similarly connected to respective lead wires 22 with similar results. In some cases, both filaments will be connected to a common lead 22 as by attaching two connectors 50 together at their free ends, which ends are then secured by welding to the common lead.

The sides of the cathode head 28 may be enclosed within a casing 54 and a cap 56 places thereover as shown in FIG. 4, an opening being provided in the cap so that the lead wires 22 may project therefrom.

From the foregoing it will be apparent that an improved connection structure is provided for attaching lead wires to filament terminals of electron discharge devices whereby the problems encountered in prior art devices of this character are overcome. It will also be apparent that the invention may be applied to electron discharge of types other than rotating anode x-ray tubes with similar success. Therefore, it will be understood that various modifications and changes may be made in the invention shown and described by those skilled in the art without departing from the spirit of the invention as expressed in the accompanying claims. Accordingly, all matter shown and described should be interpreted as illustrative and not in a limiting sense.

What is claimed is:

1. An electron discharge device having an envelope with at least one electrode therein, an electrode support comprising an insulating member, electrically conductive support means carried by said insulating member and attached at one end to said electrode, a lead wire penetrating said envelope and having an end portion terminating adjacent said support means, and a flexible electrically conductive member connecting said support means and adjacent end portion of the lead wire in stress-relieving relation thereto, said support means comprising a tubular member fixed within the insulating member, and a metal pinlike member mounted within the tubular member, the electrode being attached to the pinlike member, and the flexible member being attached to the tubular member, said tubular member having a circumferential flange thereon overlying the insulating member, a portion of said flexible member being disposed between said flange and insulating member in stable fixed relation therewith.

2. An electron discharge device as set forth in claim 1 wherein said flange and flexible member are nickel, said insulating member is ceramic, and the flexible member is affixed thereto by a titanium seal.

3. An electron-discharge device comprising an envelope with at least one electrode therein, a plurality of lead wires penetrating the envelope, an electrode support structure comprising insulating means, a plurality of electrically conductive support members carried by said insulating means, spaced portions of said electrode being connected to at least two of said support members, and flexible electrically conductive members connecting respective support members and lead wires in stress-relieving relation thereto, said insulating means comprising separate ceramic supports for each of said support members, said support structure further including a metal member having said insulating means mounted thereon, each of said support members having a circumferential flange thereon overlying the insulating member, and a portion of a flexible member being disposed between the flange and insulating member in stable fixed relation therewith.

4. An electron discharge device as set forth in claim 3 wherein said flange and flexible member are nickel, said insulating member is ceramic, and the flexible member is affixed thereto by a titanium seal.

5. An electron discharge device comprising an envelope, a cathode structure mounted within the envelope and including a filament for emitting electrons, a target positioned within the envelope and spaced from the cathode structure for receiving electrons from the filament, and lead wires extending through the envelope for connecting the filament to an external source of filament current, said cathode structure further comprising a rigid metal head, conductive filament support means extending insulatingly through said head and respectively connected to opposite end portions of the filament, and flexible metal connectors conductively connecting the support means to respective lead wires in stress-relieving relation therewith, said cathode head comprising a metal block, said insulating means comprising separate annular insulators mounted on said block, and said filament support means comprising a pair of conductive tubular members mounted in respective insulators, a pair of pinlike conductive members mounted in respective tubular members, the ends of the pinlike members being attached to respective opposite ends of the filament, the metal connectors being attached to the tubular members, said tubular members each having a circumferential flange thereon overlying the insulator, and a portion of said flexible connector being disposed between said flange and insulator in stable fixed relation therewith.

6. An electron discharge device as set forth in claim 5 wherein said flange and flexible connector are nickel, said insulating member is ceramic, and the flexible member is affixed thereto by a titanium bond.

7. An X-ray tube comprising a dielectric envelope, an anode including a target rotatably mounted in said envelope, a cathode structure fixedly mounted within the envelope and having at least one electron-emitting filament disposed in predetermined spaced relation to said target, and lead wires extending through the envelope for connecting the filament to an external source of filament current, said cathode structure further comprising a rigid metal head, conductive filament support means extending insulatingly through said head and respectively connected to opposite end portions of the filament, and flexible metal connectors conductively connecting the support means to respective lead wires in stress-relieving relation therewith.

8. An X-ray tube as set forth in claim 7 wherein said cathode head comprises a metal block, and said insulating means comprises separate annular insulators mounted on said block, and said filament support means comprises a pair of conductive tubular members mounted in respective insulators, and a pair of pinlike conductive members mounted in respective tubular members, the ends of the pinlike members being attached to respective opposite ends of the filament, and the metal connectors being attached to the tubular members.

9. An X-ray tube as set forth in claim 7 wherein each of said support members has a circumferential flange thereon overlying the insulating member, and a portion of a flexible member is disposed between the flange and insulating member in stable fixed relation therewith.

10. An X-ray tube as set forth in claim 7 wherein said tubular member has a circumferential flange thereon overlying the insulating member, and a portion of said flexible member is disposed between said flange and insulating member in stable fixed relation therewith.

11. An X-ray tube as set forth in claim 10 wherein said flange and flexible member are nickel, said insulating member is ceramic, and the flexible member is affixed thereto by a titanium seal.

* * * * *